US006236312B1

(12) United States Patent
Chitsazan et al.

(10) Patent No.: US 6,236,312 B1
(45) Date of Patent: May 22, 2001

(54) LOCATOR AND ADJUSTABLE SUPPORT DEVICE FOR A REMOTE CONTROL

(76) Inventors: Ali R. Chitsazan; Amin Chitsazan, both of 3462 Sprindel Tree Dr., Grapevine, TX (US) 76051

( * ) Notice: Subject to any disclaimer, the term of this patent is extended or adjusted under 35 U.S.C. 154(b) by 0 days.

(21) Appl. No.: 09/569,455

(22) Filed: May 12, 2000

(51) Int. Cl.[7] ..... G08B 1/08

(52) U.S. Cl. ..... 340/539; 340/825.36; 340/825.49; 340/568.1

(58) Field of Search ..... 340/539, 825.36, 340/825.49, 568.1, 588.6, 568.7, 568.8, 571; 206/305, 320

(56) References Cited

U.S. PATENT DOCUMENTS

| | | | | |
|---|---|---|---|---|
| D. 378,020 | | 2/1997 | Hatt . | |
| 4,101,873 | | 7/1978 | Anderson et al. . | |
| 4,507,653 | | 3/1985 | Bayer . | |
| 4,848,609 | | 7/1989 | Meghnot . | |
| 5,368,159 | | 11/1994 | Doria . | |
| 5,648,757 | | 7/1997 | Vernace et al. . | |
| 5,790,021 | * | 8/1998 | Mickel et al. | 340/539 |
| 5,872,702 | * | 2/1999 | Kopel | 361/810 |
| 6,050,407 | * | 4/2000 | Trujillo | 206/320 |

* cited by examiner

*Primary Examiner*—Daryl Pope

(57) ABSTRACT

A locator and adjustable support device for a remote control for protecting and locating remote control units. The locator and adjustable support device for a remote control includes includes an elongate first base member having end portions and longitudinal slots extending through and along a length of the end portions and further having a sleeve-like portion being disposed intermediate of and generally perpendicular to the end portions; and also includes support base members slidably mounted to the elongate first base member and toward and away from each other with each of the support base members having a first end and a second end; and further includes elongate second base members each of which has first end portions extendably and adjustably disposed in and from a respective end of the sleeve-like portion and each of which has a second end; and also includes a plurality of frame support members securely attached to the support base members and to the elongate second base members; and further includes a plurality of frame members supported by the frame support members; and also includes a plurality of cover members securely mounted to the frame members and being adapted to generally enclose about and protect a remote control device; and further includes a locator unit removably and securely disposed in one of the cover members for allowing a user to find the remote control device.

16 Claims, 6 Drawing Sheets

LOCATOR AND ADJUSTABLE SUPPORT DEVICE FOR A REMOTE CONTROL

BACKGROUND OF THE INVENTION

1. Field of the Invention

The present invention relates to a remote control frame and locator and more particularly pertains to a new locator and adjustable support device for a remote control for protecting and locating remote control units.

2. Description of the Prior Art

The use of a remote control frame and locator is known in the prior art. More specifically, a remote control frame and locator heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,648,757; 4,848,609; 5,368,159; 4,507,653; U.S. Pat. No. Des. 378,020; and U.S. Pat. No. 4,101,873.

While these devices fulfill their respective, particular objectives and requirements, the aforementioned patents do not disclose a new locator and adjustable support device for a remote control. The inventive device includes an elongate first base member having end portions and longitudinal slots extending through and along a length of the end portions and further having a sleeve-like portion being disposed intermediate of and generally perpendicular to the end portions; and also includes support base members slidably mounted to the elongate first base member and toward and away from each other with each of the support base members having a first end and a second end; and further includes elongate second base members each of which has first end portions extendably and adjustably disposed in and from a respective end of the sleeve-like portion and each of which has a second end; and also includes a plurality of frame support members securely attached to the support base members and to the elongate second base members; and further includes a plurality of frame members supported by the frame support members; and also includes a plurality of cover members securely mounted to the frame members and being adapted to generally enclose about and protect a remote control device; and further includes a locator unit removably and securely disposed in one of the cover members for allowing a user to find the remote control device.

In these respects, the locator and adjustable support device for a remote control according to the present invention substantially departs from the conventional concepts and designs of the prior art, and in so doing provides an apparatus primarily developed for the purpose of protecting and locating remote control units.

SUMMARY OF THE INVENTION

In view of the foregoing disadvantages inherent in the known types of remote control frame and locator now present in the prior art, the present invention provides a new locator and adjustable support device for a remote control construction wherein the same can be utilized for protecting and locating remote control units.

The general purpose of the present invention, which will be described subsequently in greater detail, is to provide a new locator and adjustable support device for a remote control which has many of the advantages of the remote control frame and locator mentioned heretofore and many novel features that result in a new locator and adjustable support device for a remote control which is not anticipated, rendered obvious, suggested, or even implied by any of the prior art remote control frame and locator, either alone or in any combination thereof.

To attain this, the present invention generally comprises includes an elongate first base member having end portions and longitudinal slots extending through and along a length of the end portions and further having a sleeve-like portion being disposed intermediate of and generally perpendicular to the end portions; and also includes support base members slidably mounted to the elongate first base member and toward and away from each other with each of the support base members having a first end and a second end; and further includes elongate second base members each of which has first end portions extendably and adjustably disposed in and from a respective end of the sleeve-like portion and each of which has a second end; and also includes a plurality of frame support members securely attached to the support base members and to the elongate second base members; and further includes a plurality of frame members supported by the frame support members; and also includes a plurality of cover members securely mounted to the frame members and being adapted to generally enclose about and protect a remote control device; and further includes a locator unit removably and securely disposed in one of the cover members for allowing a user to find the remote control device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new locator and adjustable support device for a remote control which has many of the advantages of the remote control frame and locator mentioned heretofore and many novel features that result in a new locator and adjustable support device for a remote control which is not anticipated, rendered obvious, suggested, or even implied by any of the prior art remote control frame and locator, either alone or in any combination thereof.

It is another object of the present invention to provide a new locator and adjustable support device for a remote control which may be easily and efficiently manufactured and marketed.

It is a further object of the present invention to provide a new locator and adjustable support device for a remote control which is of a durable and reliable construction.

An even further object of the present invention is to provide a new locator and adjustable support device for a remote control which is susceptible of a low cost of manufacture with regard to both materials and labor, and which accordingly is then susceptible of low prices of sale to the consuming public, thereby making such locator and adjustable support device for a remote control economically available to the buying public.

Still yet another object of the present invention is to provide a new locator and adjustable support device for a remote control which provides in the apparatuses and methods of the prior art some of the advantages thereof, while simultaneously overcoming some of the disadvantages normally associated therewith.

Still another object of the present invention is to provide a new locator and adjustable support device for a remote control for protecting and locating remote control units.

Yet another object of the present invention is to provide a new locator and adjustable support device for a remote control which includes includes an elongate first base member having end portions and longitudinal slots extending through and along a length of the end portions and further having a sleeve-like portion being disposed intermediate of and generally perpendicular to the end portions; and also includes support base members slidably mounted to the elongate first base member and toward and away from each other with each of the support base members having a first end and a second end; and further includes elongate second base members each of which has first end portions extendably and adjustably disposed in and from a respective end of the sleeve-like portion and each of which has a second end; and also includes a plurality of frame support members securely attached to the support base members and to the elongate second base members; and further includes a plurality of frame members supported by the frame support members; and also includes a plurality of cover members securely mounted to the frame members and being adapted to generally enclose about and protect a remote control device; and further includes a locator unit removably and securely disposed in one of the cover members for allowing a user to find the remote control device.

Still yet another object of the present invention is to provide a new locator and adjustable support device for a remote control that can be easily and conveniently adjusted to fit about any remote control unit of any size.

Even still another object of the present invention is to provide a new locator and adjustable support device for a remote control that effectively protects the remote control unit and emits a sound when the remote control unit is lost.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
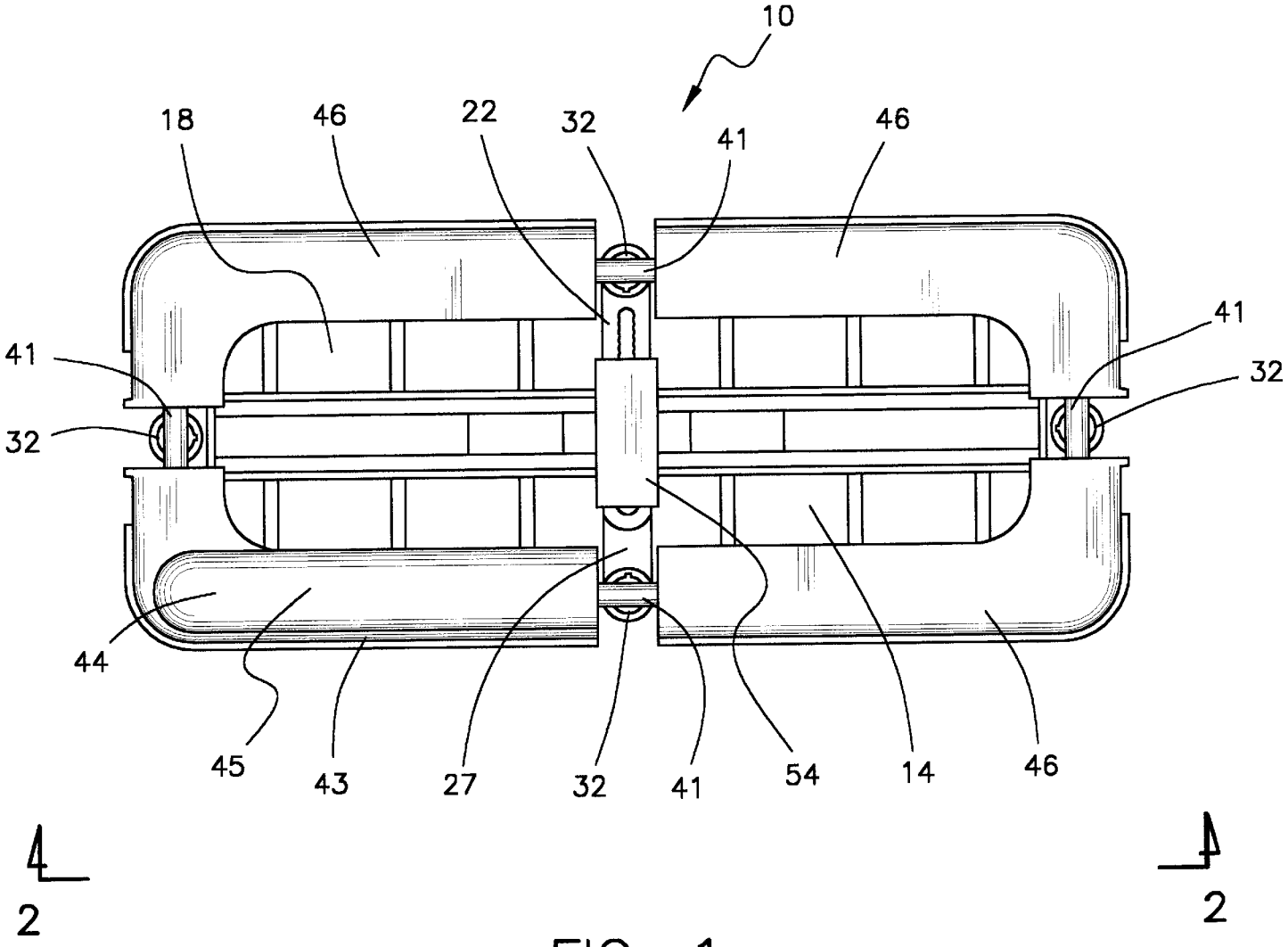
FIG. 1 is a top plan view of a new locator and adjustable support device for a remote control according to the present invention.
Figure 2:
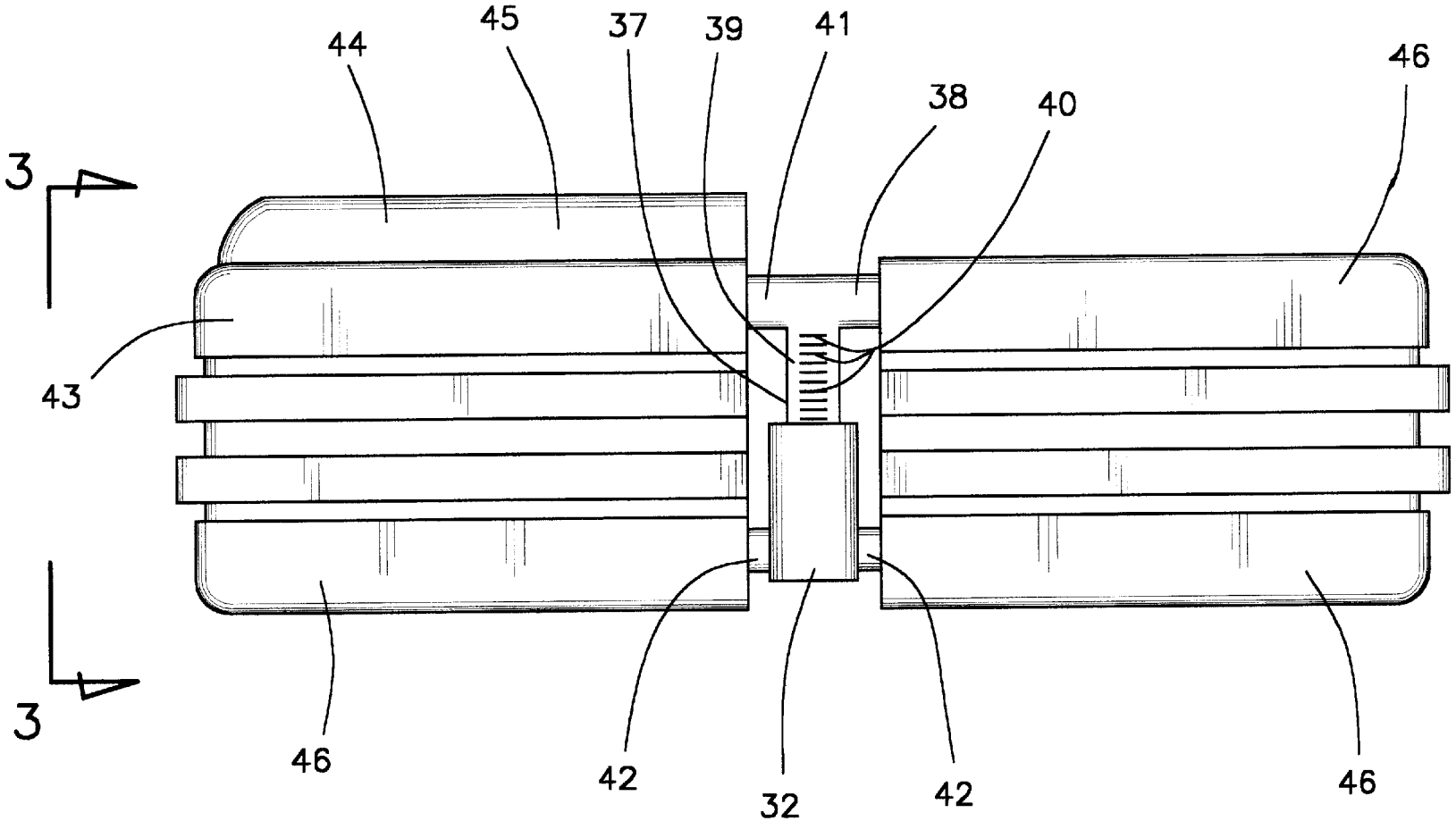
FIG. 2 is a side elevational view of the present invention.
Figure 3:
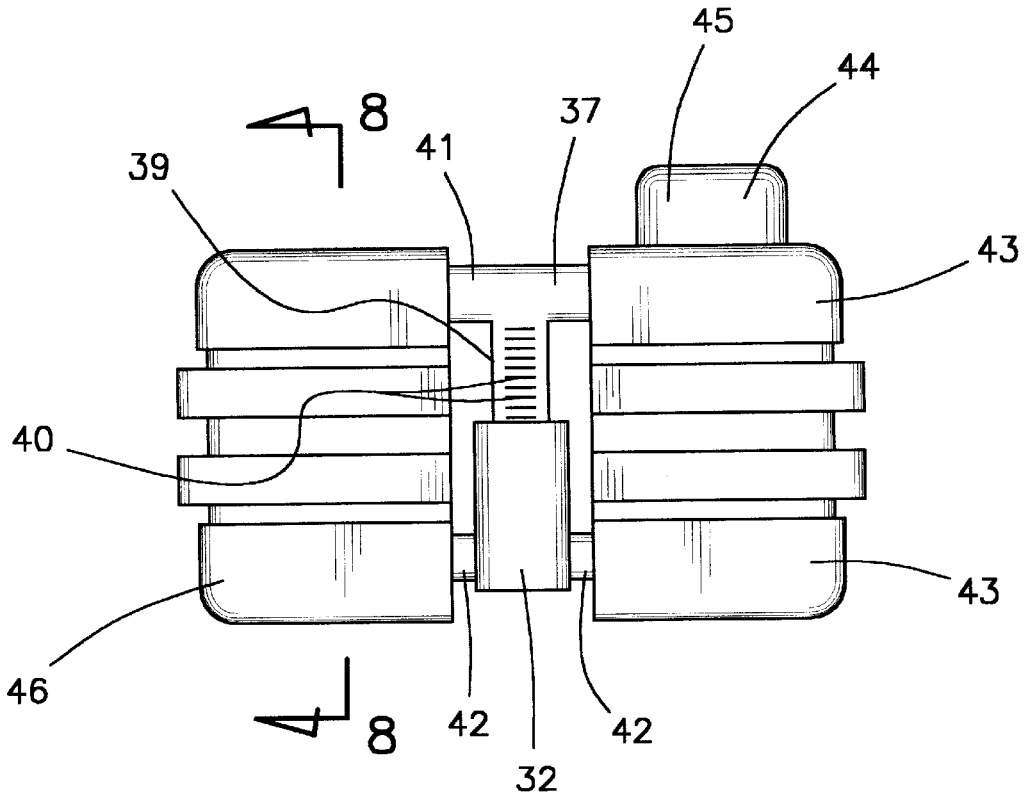
FIG. 3 is an end elevational view of the present invention.
Figure 4:
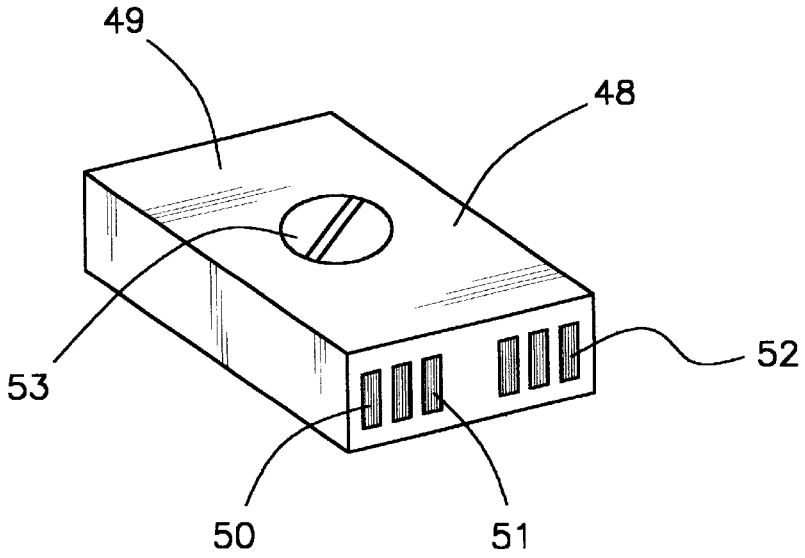
FIG. 4 is a perspective view of the locator unit of the present invention.
Figure 5:
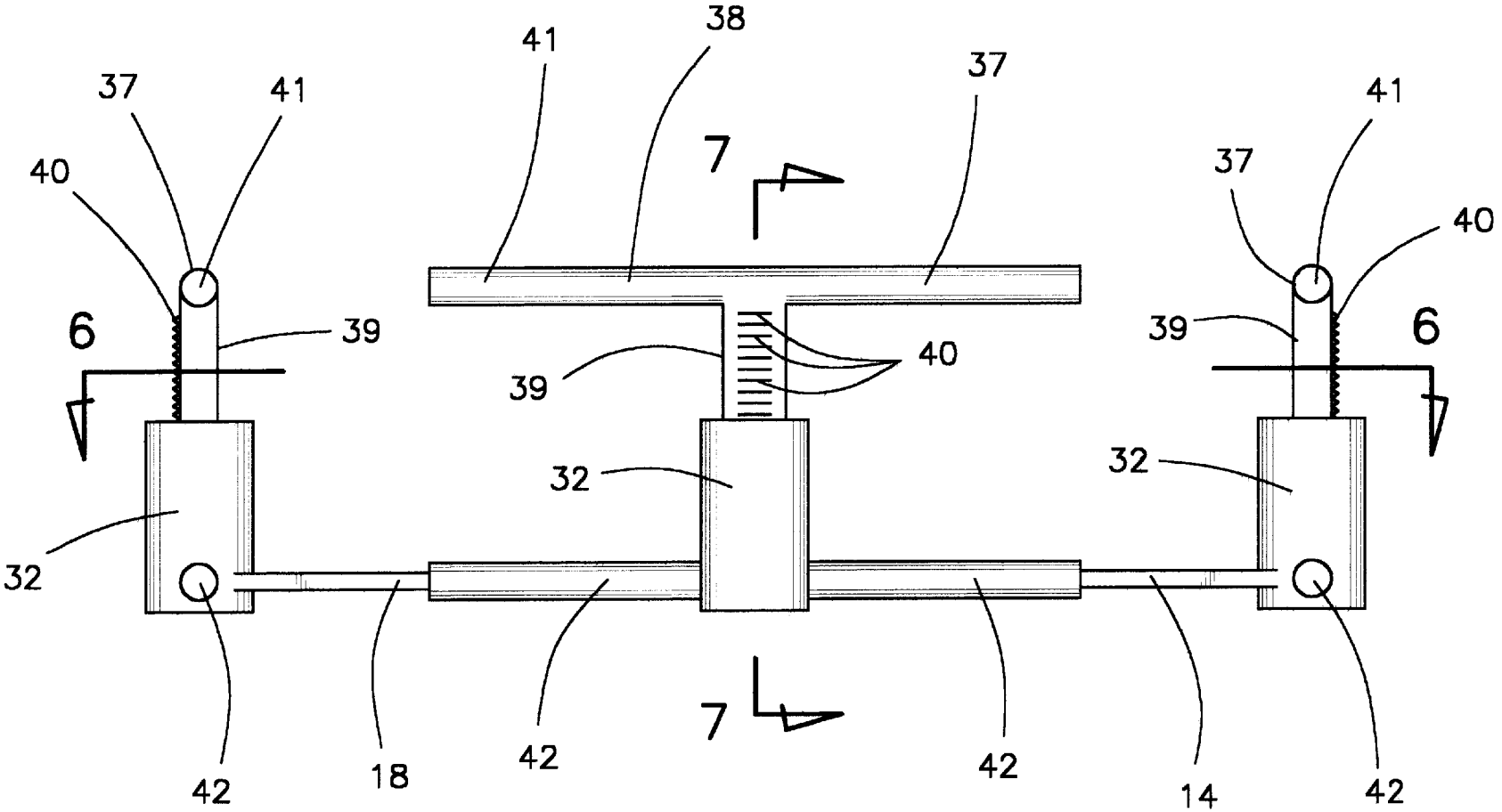
FIG. 5 is a side elevational view of the support base members, support frame members, and the frame members of the present invention.
Figure 6:
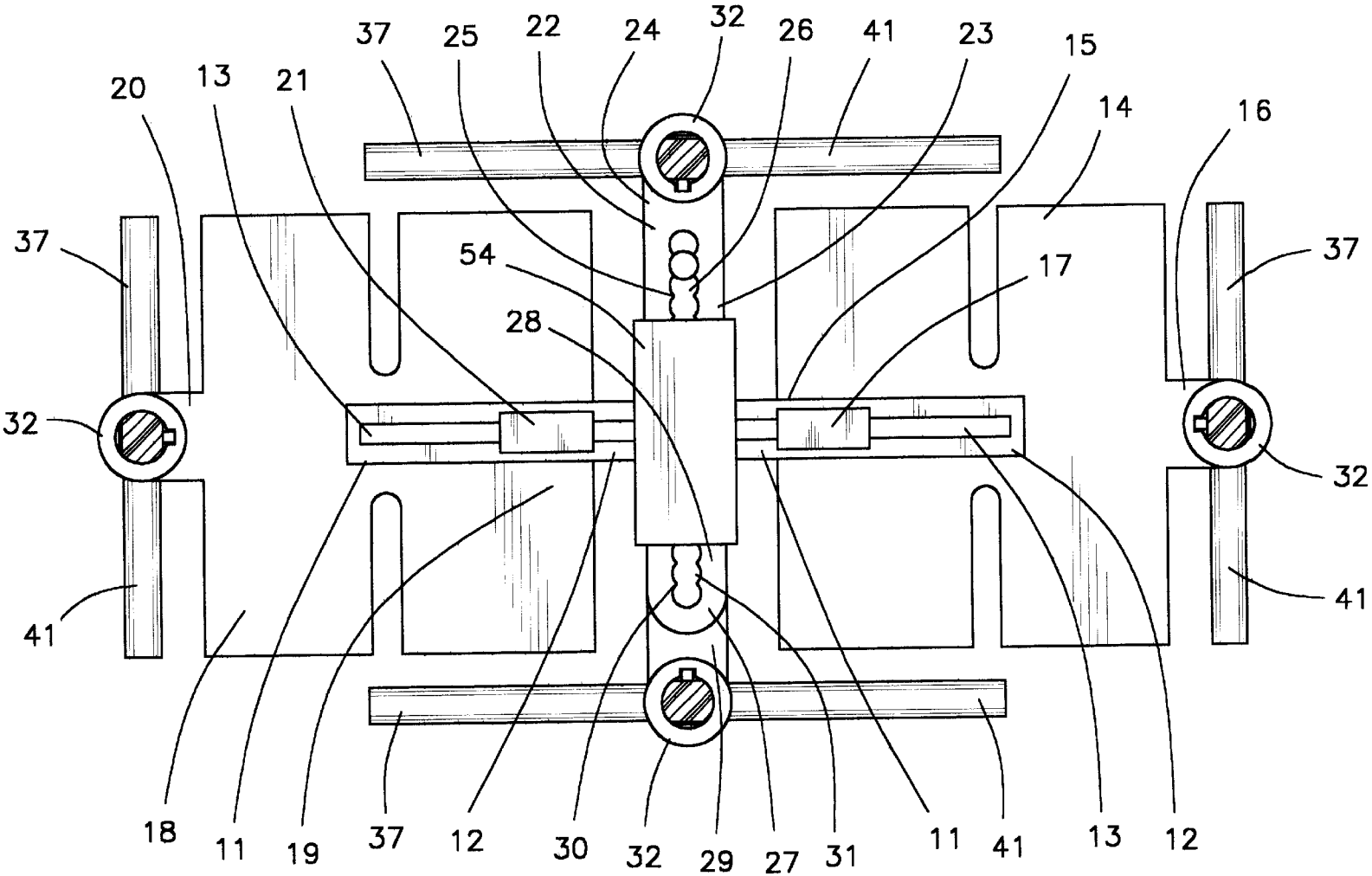
FIG. 6 is a top plan view of the support base members, first base member, second base members, support frame members, and the frame members of the present invention.
Figure 7:
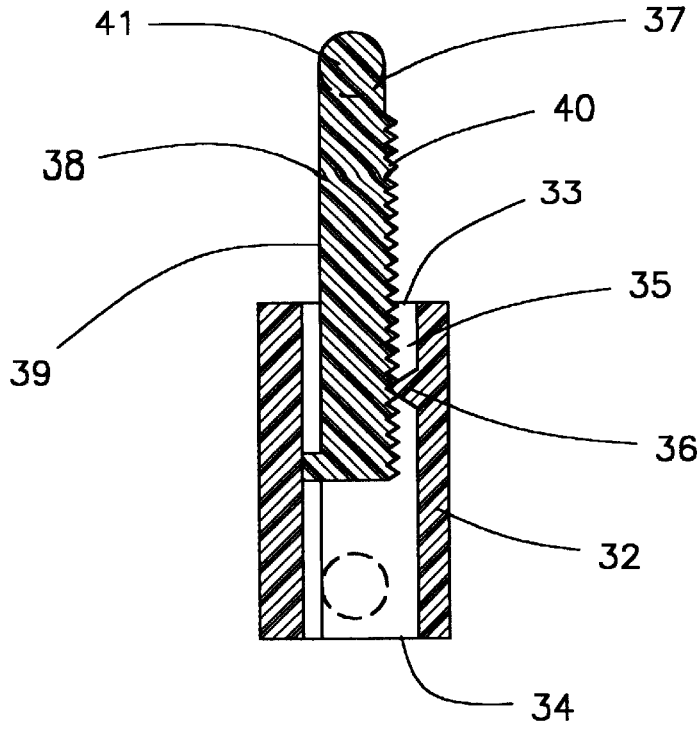
FIG. 7 is a cross-sectional view of one of the frame support members and one of the frame members of the present invention.
Figure 8:
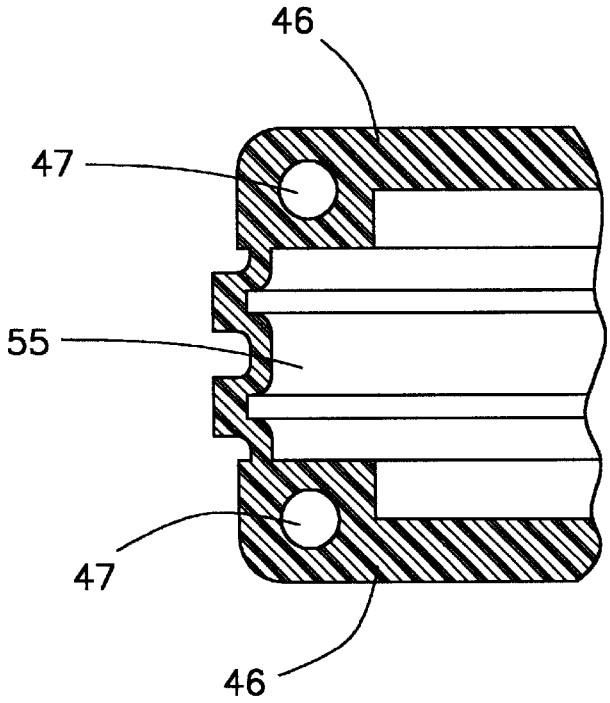
FIG. 8 is a cross-sectional view of an end of a cover member of the present invention.

With reference now to the drawings, and in particular to FIGS. 1 through 8 thereof, a new locator and adjustable support device for a remote control embodying the principles and concepts of the present invention and generally designated by the reference numeral 10 will be described.

As best illustrated in FIGS. 1 through 8, the locator and adjustable support device for a remote control 10 generally comprises an elongate first base member 11 having end portions 12 and longitudinal slots 13 extending through and along a length of the end portions 12 and further having a sleeve-like portion 54 being securely and conventionally disposed intermediate of and generally perpendicular to the end portions 12. Support base members 14,18 are slidably mounted to the elongate first base member 11 and toward and away from each other. Each of the support base members 14,18 has a first end 15,19 and a second end 16,20 with each of the support base members 14,18 being essentially a plate-like member having side edges and further having a connector 17,21 securely and conventionally disposed upon and extending outwardly from a top side and near the first end 15,19 thereof and being slidably retained in a respective one of the longitudinal slots 13 of the elongate first base member 11. The support base members 14,18 are adapted to support the remote control unit 55 thereupon.

The locator and adjustable support device for a remote control 10 also includes elongate second base members 22,27 each of which has a first end portion 23,28 extendably and adjustably disposed in and from a respective end of the sleeve-like portion 54 and each of which has a second end 24,29. Each of the elongate second base members 22,27 includes a slot 25,30 extending through and along a length of the first end portion 23,28, and includes a plurality of notches 26,31 disposed in and along edges forming the slot 25,30 and being adapted to securely retain a respective elongate second base member 22,27 at selected positions within the sleeve-like portion 54.

A plurality of frame support members 32 are securely and conventionally attached to the support base members 14,18 and to the elongate second base members 22,27. Each of the frame support members 32 includes a cylindrical member having an open end 33, a closed end 34, and a bore 35 extending therein, and also includes a nib-like member 36 securely and conventionally disposed in the bore 35 and securely attached to a wall forming the bore 35. The frame support members 32 includes a first two of the frame support members which are securely attached at the second ends 24,29 of the elongate second base members 22,27 with each of the first two of the frame support members being securely attached at the second end 24,29 of a respective elongate second base member 22,27. The frame support members 32 also includes a second two of the frame support members which are securely attached at the second ends 16,20 of the support base members 14,18 with each of the second two of the frame support members being securely attached at the second end 16,20 of a respective support base member 14,18.

A plurality of frame members 37 are securely supported by the frame support members 32. The frame members 32 include a plurality of T-shaped members 38 and a plurality of elongate cross member 42. Each of the T-shaped members 38 includes a main portion 39 and a cross portion 41 which is securely and conventionally attached at an end of the main portion 39. Each of the main portions 39 includes a plurality of teeth members 41 securely and conventionally disposed upon and along an exterior thereof and being engageable with the nib-like member 36 in a respective frame support member 32. Each of the main portions 39 are extendable and lockable at selected positions within the bore 35 of a respective frame support member 32. Each of the elongate cross members 42 are securely and conventionally attached to and extend outwardly from a respective frame support member 32.

A plurality of cover members 43,46 are securely and conventionally mounted to the frame members 37 and are adapted to generally and adjustably enclose about and protect a remote control unit 55. Each of the cover members 43,46 includes a wall having an outer side and an inner side and also having ends and further having a bore 47 extending through the wall and through the ends and being adapted to receive a respective elongate cross member 42 and a respective cross portion 41 of the frame members 37. One of the cover members 43 includes the wall having a protruding portion 44 extending outwardly of the outer side and also includes a compartment 45 disposed in the protruding portion 44. Each of the cover members 43,46 further includes a main portion and an angled end portion through which the bore 47 extends. The cover members 43,46 are made of an illuminating rubber-like material to glow and to prevent breakage of the remote control unit 55.

A locator unit 48 is removably and securely disposed in one of the cover members 43,46 for allowing a user to find the remote control device 55. The compartment 45 is adapted to receive and hold the locator unit 48. The locator unit 48 includes a housing 49, a conventional sound sensor member 50 securely and conventionally disposed in the housing 49, a conventional sound chip member 51 also securely and conventionally disposed in the housing 49, a speaker member 52 securely and conventionally disposed in a wall of the housing 49, and a battery 53 securely and conventionally disposed in the housing 49 and being adapted to energize the sound chip member 51 for emitting a sound upon a user making a noise which is sensed by the sound sensor member 50.

In use, the user secures a remote control unit 55 of any size within the frame members 37 and cover members 43,46 since the frame members 37 are adjustable as to length, width, and depth. The cover members 43,46 protect the remote control unit from breaking and also retains the locator unit 48 which is adapted to emit a beeping sound upon the user initiating a sound such as hand clapping. The locator unit 48 allows the user to quickly locate a lost remote control unit 55.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A locator and adjustable support device for a remote control comprising:

an elongate first base member having end portions and longitudinal slots extending through and along a length of said end portions and further having a sleeve-like portion being disposed intermediate of and generally perpendicular to said end portions;

support base members slidably mounted to said elongate first base member and toward and away from each other, each of said support base members having a first end and a second end;

elongate second base members each of which has first end portions extendably and adjustably disposed in and from a respective end of said sleeve-like portion and each of which has a second end;

a plurality of frame support members securely attached to said support base members and to said elongate second base members;

a plurality of frame members supported by said frame support members;

a plurality of cover members securely mounted to said frame members and being adapted to generally enclose about and protect a remote control device; and a locator unit removably and securely disposed in one of said cover members for allowing a user to find the remote control device.

2. A locator and support device for a remote control as described in claim 1, wherein each of said support base members is essentially a plate-like member having side edges and further having a connector securely disposed upon and extending outwardly from a top side and near said first end thereof and being slidably retained in a respective one of said longitudinal slots of said elongate first base member, said support base members being adapted to support the remote control unit thereupon.

3. A locator and support device for a remote control as described in claim 2, wherein each of said elongate second base members includes a slot extending through and along a length of said first end portion, and includes a plurality of notches disposed in and along edges forming said slot and being adapted to securely retain a respective said elongate second base member at selected positions within said sleeve-like portion.

4. A locator and support device for a remote control as described in claim 3, wherein each of said frame support members includes a cylindrical member having an open end, a closed end, and a bore extending therein, and also including a nib-like member securely disposed in said bore and securely attached to a wall forming said bore.

5. A locator and support device for a remote control as described in claim 4, wherein said frame support members includes a first two of said frame support members which are securely attached at said second ends of said elongate second base member, each of said first two of said frame support members being securely attached at said second end of a respective said elongate second base member.

6. A locator and support device for a remote control as described in claim 5, wherein said frame support members also includes a second two of said frame support members which are securely attached at said second ends of said support base members, each of said second two of said frame support members being securely attached at said second end of a respective said support base member.

7. A locator and support device for a remote control as described in claim 6, wherein said frame members includes a plurality of T-shaped members and a plurality of elongate cross member.

8. A locator and support device for a remote control as described in claim 7, wherein each of said T-shaped members includes a main portion and a cross portion which is securely attached at an end of said main portion, each of said main portions including a plurality of teeth members securely disposed upon and along an exterior thereof and being engageable with said nib-like member in a respective said frame support member, each of said main portions being extendable and lockable at selected positions within said bore of a respective said frame support member.

9. A locator and support device for a remote control as described in claim 8, wherein each of said elongate cross members is securely attached to and extends outwardly from a respective said frame support member.

10. A locator and support device for a remote control as described in claim 9, wherein each of said cover members includes a wall having an outer side and an inner side and also having ends and further having a bore extending through said wall and through said ends and being adapted to receive a respective said elongate cross member and a respective said cross portion of said frame members.

11. A locator and support device for a remote control as described in claim 10, wherein one of said cover members includes said wall having a protruding portion extending outwardly of said outer side and also includes a compartment disposed in said protruding portion.

12. A locator and support device for a remote control as described in claim 11, wherein said compartment is adapted to receive and hold said locator unit.

13. A locator and support device for a remote control as described in claim 12, wherein each of said cover members further includes a main portion and an angled end portion through which said bore extends.

14. A locator and support device for a remote control as described in claim 13, wherein said locator unit includes a housing, a sound sensor member disposed in said housing, a sound chip member also disposed in said housing, a speaker member disposed in a wall of said housing, and a battery disposed in said housing and being adapted to energize said sound chip member for emitting a sound upon a user making a noise which is sensed by said sound sensor member.

15. A locator and support device for a remote control as described in claim 14, wherein said cover members are made of an illuminating rubber-like material to glow and to prevent breakage of the remote control unit.

16. A locator and adjustable support device for a remote control comprising:

an elongate first base member having end portions and longitudinal slots extending through and along a length of said end portions and further having a sleeve-like portion being disposed intermediate of and generally perpendicular to said end portions;

support base members slidably mounted to said elongate first base member and toward and away from each other, each of said support base members having a first end and a second end, each of said support base members being essentially a plate-like member having side edges and further having a connector securely disposed upon and extending outwardly from a top side and near said first end thereof and being slidably retained in a respective one of said longitudinal slots of said elongate first base member, said support base members being adapted to support the remote control unit thereupon;

elongate second base members each of which has first end portions extendably and adjustably disposed in and from a respective end of said sleeve-like portion and each of which has a second end, each of said elongate second base members including a slot extending through and along a length of said first end portion, and including a plurality of notches disposed in and along edges forming said slot and being adapted to securely retain a respective said elongate second base member at selected positions within said sleeve-like portion;

a plurality of frame support members securely attached to said support base members and to said elongate second base members, each of said frame support members includes a cylindrical member having an open end, a closed end, and a bore extending therein, and also including a nib-like member securely disposed in said bore and securely attached to a wall forming said bore, said frame support members including a first two of said frame support members which are securely attached at said second ends of said elongate second base member, each of said first two of said frame support members being securely attached at said second end of a respective said elongate second base member, said frame support members also including a second two of said frame support members which are securely attached at said second ends of said support base members, each of said second two of said frame support members being securely attached at said second end of a respective said support base member;

a plurality of frame members supported by said frame support members, said frame members including a plurality of T-shaped members and a plurality of elongate cross member, each of said T-shaped members including a main portion and a cross portion which is securely attached at an end of said main portion, each of said main portions including a plurality of teeth members securely disposed upon and along an exterior thereof and being engageable with said nib-like member in a respective said frame support member, each of said main portions being extendable and lockable at selected positions within said bore of a respective said frame support member, each of said elongate cross members being securely attached to and extending outwardly from a respective said frame support member;

a plurality of cover members securely mounted to said frame members and being adapted to generally enclose about and protect a remote control device, each of said cover members including a wall having an outer side and an inner side and also having ends and further having a bore extending through said wall and through said ends and being adapted to receive a respective said elongate cross member and a respective said cross portion of said frame members, one of said cover members including said wall having a protruding portion extending outwardly of said outer side and also including a compartment disposed in said protruding portion, each of said cover members further including a main portion and an angled end portion through which said bore extends, said cover members being made of an illuminating rubber-like material to glow and to prevent breakage of the remote control unit; and a locator unit removably and securely disposed in one of said cover members for allowing a user to find the remote control device, said compartment being adapted to receive and hold said locator unit, said locator unit including a housing, a sound sensor member disposed in said housing, a sound chip member also disposed in said housing, a speaker member disposed in a wall of said housing, and a battery disposed in said housing and being adapted to energize said sound chip member for emitting a sound upon a user making a noise which is sensed by said sound sensor member.

* * * * *